US007377252B2

(12) United States Patent
Tsuruta et al.

(10) Patent No.: US 7,377,252 B2
(45) Date of Patent: May 27, 2008

(54) INTERNAL COMBUSTION ENGINE PROVIDED WITH OIL FILTER

(75) Inventors: Tatsunori Tsuruta, Saitama (JP); Noriaki Kawai, Saitama (JP); Chihiro Nishikawa, Saitama (JP); Akihiro Konishi, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/730,019

(22) Filed: Mar. 29, 2007

(65) Prior Publication Data

US 2007/0227490 A1 Oct. 4, 2007

(30) Foreign Application Priority Data

Mar. 30, 2006 (JP) ..... 2006-095994

(51) Int. Cl.
*F01M 11/03* (2006.01)

(52) U.S. Cl. ..... 123/196 A; 123/195 C

(58) Field of Classification Search ..... 123/196 R, 123/195 C

See application file for complete search history.

(56) References Cited

FOREIGN PATENT DOCUMENTS

JP 62-45315 U 3/1987
JP 11107732 A * 4/1999

* cited by examiner

*Primary Examiner*—Noah P. Kamen
(74) *Attorney, Agent, or Firm*—Arent Fox LLP

(57) ABSTRACT

An internal combustion engine is provided with an oil filter 10 through which lubricant oil having pulsating pressure passes. The oil filter 10 has an oil filter body 11 attached to a filter base 20, and a cover 30 formed integrally with the filter base 20 and circumferentially surrounding the oil filter body 11. The cover 30 is provided with a window part 36 through which a space 35 formed between the oil filter body 11 and the cover 30 opens outward. The cover 30 has a circumferentially endless annular end wall 33 provided between the window part 36 and an end wall 33*a*. The cover 30 has a reinforcing member 41 provided with an opening part 46 and attached to the outside surface of the cover 30 so that the opening part 46 coincides with the window part 36 of the cover 30. The oil filter 10 can be properly cooled and sounds radiated by the oil filter 10 and the cover 30 can be reduced.

9 Claims, 8 Drawing Sheets

INTERNAL COMBUSTION ENGINE PROVIDED WITH OIL FILTER

BACKGROUND OF THE INVENTION

1. Field of the Invention

The present invention relates to an internal combustion engine provided with an oil filter through which lubricant oil discharged from a positive-displacement oil pump flows. More specifically, the present invention relates to an oil filter including a filter base, an oil filter body attached to the filter base, and a cover for covering the oil filter body.

2. Description of the Related Art

During the maintenance work for an oil filter including a filter base attached to an internal combustion engine and an oil filter body attached to the filter base, such as oil filter body changing work, oil leaks in some cases from the filter base. A known oil filter disclosed in, for example, JP-U 62-45315 includes a filter base provided with an oil guard or a wall to prevent the oil that has leaked from the filter base from contaminating components of the internal combustion engine placed around the filter base.

The volume of the pump chamber of a positive-displacement oil pump is varied to suck oil into and to discharge oil from the pump chamber. Therefore, the pressure of the oil in the discharge passage through which the oil discharged from the oil pump flows pulsates. An oil filter placed in the discharge passage is vibrated by the pulsating pressure of the oil and radiates noise or sound.

If a cover covering the oil filter body is enlarged to reduce the radiation of sound and to enhance the oil stopping effect of the cover, the oil filter cannot be satisfactorily cooled by air around the oil filter and by wind that flows against a vehicle provided with the internal combustion engine when the vehicle runs.

Referring to FIG. 12, when a cylindrical cover b covering an oil filter a formed integrally with a filter base is provided with an opening c extending from an open end part b2 toward a base end part b1 to allow air to flow through the cover b, corners of the edges e of the opening c are likely to be vibrated by the pulsating pressure of the oil in an oil passage formed in the filter base and the sound radiated by the oil filter a. Thus, in some cases, the cover b radiates sound.

When a component member or an engine body of an internal combustion engine is disposed near the cover b opposite to the cover b with respect to a diametrical direction, it is possible that large sound are generated by the resonance of the cover b or the component member or the engine body due to the propagation of the sound generated by the cover b and the sound radiated by the component member or the engine body in a space between the cover b and the component member or the engine body.

SUMMARY OF THE INVENTION

The present invention has been made under such circumstances and it is therefore an object of the present invention to provide an oil filter capable of being properly cooled and to reduce sound radiated by the oil filter and a cover covering the oil filter. Another object of the present invention is to reduce sound radiated by a cover by reinforcing the cover, to reduce sound radiated by the resonance of a cover and an engine body, and to improve an effect of preventing contamination of an exhaust pipe with oil.

The present invention provides an internal combustion engine provided with an oil filter for cleaning lubricant oil discharged by a positive-displacement oil pump, said oil filter comprising: a filter base attached to an engine body of the internal combustion engine; and an oil filter body attached to the filter base and having a base part having a joining surface closely joined to the filter base and a head part opposite the base part; wherein the oil filter body is provided with a cover having a base part formed integrally with the filter base and a head part axially opposite the base part, and circumferentially surrounding the oil filter body, the oil filter body and the cover forms a space between the oil filter body and the cover, the cover is provided with a window part through which the space opens diametrically outward, and the cover has a circumferentially endlessly continuous part in a region axially extending between the window part and the head part.

According to the present invention, air can flow through the opening into and out of the space between the oil filter body and the cover covering the oil filter body. Therefore, the oil filter body can be properly cooled by air even if most part of the oil filter body is covered with the cover. The circumferentially endlessly continuous part in the part axially extending between the opening and the head part enhances the rigidity of the cover provided with the opening. Consequently, the vibration of the cover caused by sound radiated by the oil filter vibrated by the pulsating pressure of the oil discharged from the oil pump can be suppressed and the sound radiated by the cover is reduced.

According to the present invention, the internal combustion engine may have a reinforcing structure for reinforcing an edge part of the window part of the cover.

The reinforcing means enhances the rigidity of a part of the cover around the window part and hence sound radiated by the cover due to the reduction of the rigidity of the cover caused by the window part can be reduced.

Preferably, the cover includes a cylindrical cover body provided with the window part, and a reinforcing member attached to the cover body and having an opening part coinciding with the window part of the cover body, the continuous part is formed integrally with the cover body, and an edge part around the opening part of the reinforcing member coincides with an edge part around the window part of the cover body.

The reinforcing member enhances the rigidity of the part of the cover body around the window part. Since the edge part around the opening part of the reinforcing member coincides with the edge part around the window part of the cover body, the rigidity of the part of the cover body around the window part is further enhanced and hence sound radiated by the cover can be further reduced. The characteristics of the sound radiated by the cover can be changed by forming the reinforcing member of a material different from that of the cover body. Therefore, an effective range of radiated sound reducing effect can be adjusted according to the frequency of the pulsating oil pressure.

Preferably, the window part of the cover is formed at a position diametrically opposite the engine body.

Thus the resonance of the engine body caused by the sound radiated by the cover in the space between the cover and the engine body can be suppressed and the sound radiated by the cover can be attenuated when the cover is disposed close to the engine body.

The head part may be provided with an axially opened opening, and the cover may be disposed between the oil filter and an exhaust pipe connected to the engine body so as to extend downward from the filter base such that the head part is at a level below the exhaust pipe.

Since the head part of the cover is at a level below the exhaust pipe, the oil that has leaked from the filter base is prevented from contaminating the exhaust pipe. Thus an effect of preventing the contamination of the exhaust pipe with the oil can be enhanced.

The space between the oil filter body and the cover may be an annular space. Preferably, the window part of the cover includes a plurality of axially adjoining holes. The reinforcing member may be formed of a plate, may include two attaching parts attached respectively to parts of the cover respectively on the circumferentially opposite sides of the window part, and a covering part having a cross-sectional shape resembling a circular arc and extending along the circumference of the oil filter body between the two attaching parts. The covering part may be provided with an opening part of a shape corresponding to that of the window part of the cover.

DESCRIPTION OF THE PREFERRED EMBODIMENTS

Preferred embodiments of the present invention will be described with reference to FIGS. 1 to 11.

Figure 1:
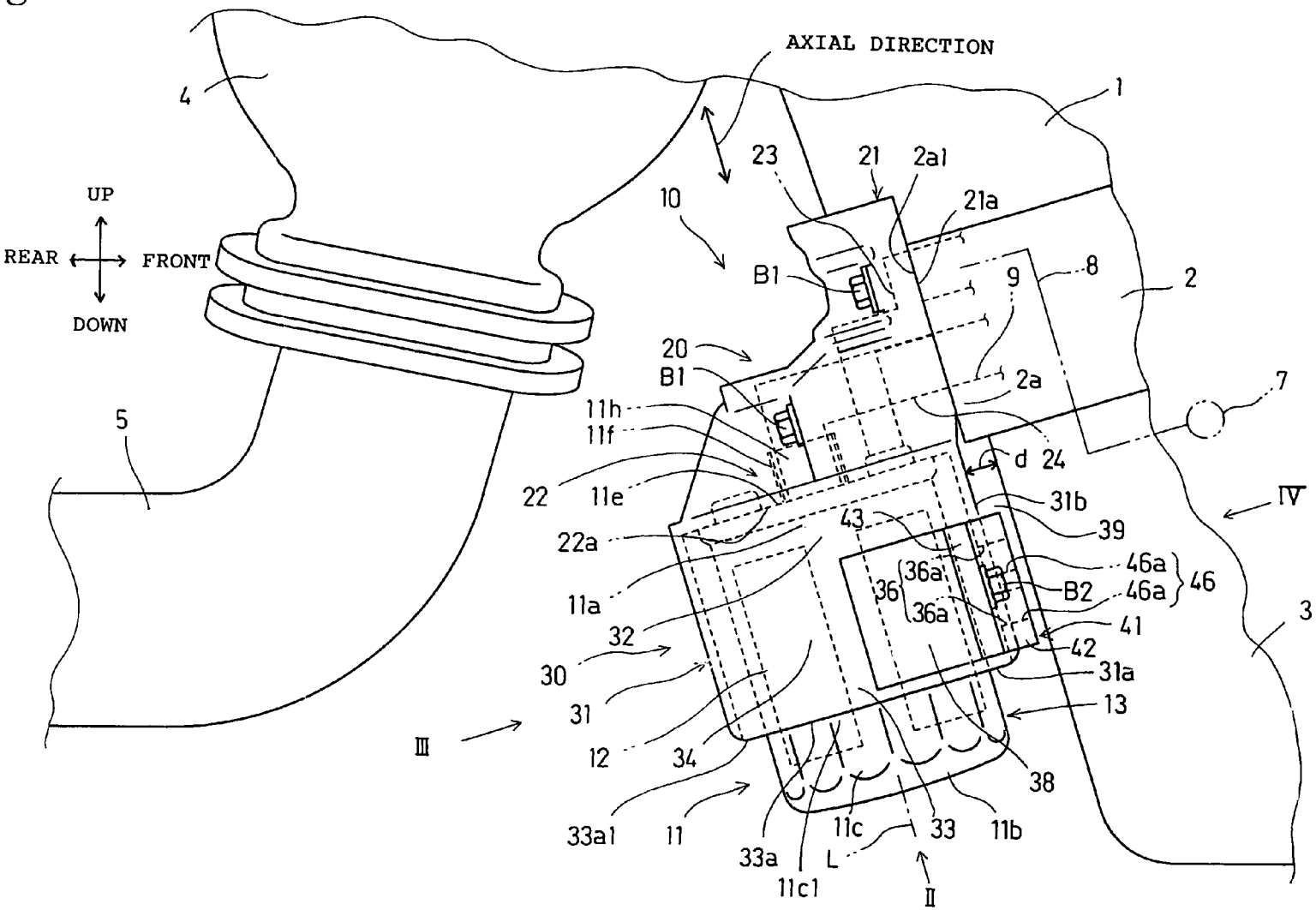
FIG. 1 is a side elevation of an essential part of an internal combustion engine in a preferred embodiment of the present invention.

Referring to FIG. 1, an internal combustion engine according to the present invention is a multiple cylinder 4-stroke internal combustion engine mounted on a transverse-engine vehicle with its crankshaft transversely extended. The internal combustion engine has an engine body including a cylinder block 1 provided with in-line cylinders in which pistons are axially slidably fitted, respectively, for reciprocation, a cylinder head (not shown) joined to the upper end surface of the cylinder block 1, a lower block 2 joined to the lower end surface of the cylinder block 1, and an oil pan 3 joined to the lower end surface of the lower block 2.

The flow of intake air flowing through an intake system of the internal combustion engine is controlled by a throttle valve. An air-fuel mixture is produced by mixing the intake air with fuel injected through a fuel injection valve. The air-fuel mixture supplied into combustion chambers is ignited by an ignition plug for combustion. The crankshaft rotatably supported in main bearings on the cylinder block 1 and the lower block 2 is driven for rotation by the pistons reciprocated by the pressure of a combustion gas produced in the combustion chambers. Then, the combustion gas is discharged as an exhaust gas from the internal combustion engine through an exhaust system including a catalytic converter 4 connected directly to the cylinder head and an exhaust pipe 5 on the downstream side of the catalytic converter 4.

A lubricating system for lubricating moving parts to be lubricated in the internal combustion engine includes a positive-displacement oil pump 7 rotatively driven by the crankshaft to pump up the lubricant oil contained in the oil pan 3 and to send out the oil by pressure, and an oil filter 10 for filtering the oil discharged by the oil pump 7 to clean the oil.

The oil pump 7, namely, a trochoid oil pump, is disposed in a crankcase defined by a lower part of the cylinder block 1, the lower block 2 and the oil pan 3, and holding the crankshaft 4 therein. The oil pump 7 is attached to the lower block 2. The oil pump 7 rotatively driven by the crankshaft sucks the oil contained in the oil pan 3 into a pump chamber in a suction stroke in which the volume of the pump chamber increases, and discharges the oil from the pump chamber into a discharge passage 8 formed in the lower block 2 in a discharge stroke in which the volume of the pump chamber decreases. The oil discharged into the discharge passage 8 flows through an oil filter 10 and through an oil passage 9 into a main gallery formed in the cylinder block 1. The oil that has flowed into the main gallery is distributed through many oil passages to the moving parts to be lubricated.

Figure 2:
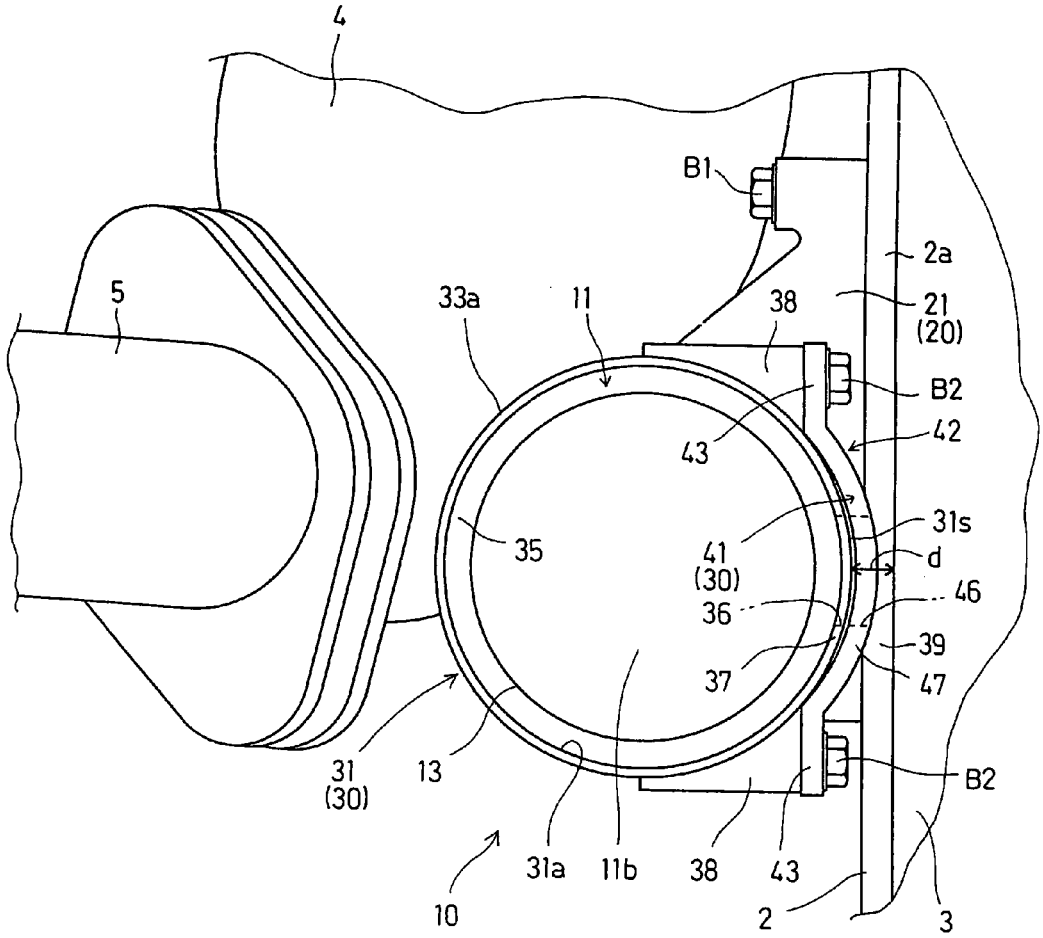
FIG. 2 is a view taken in the direction of the arrow II in FIG. 1.

Referring also to FIG. 2, the oil filter 10 includes a filter base 20 attached to the lower block 2, an oil filter body 11 provided with a built-in filter element 12, having a tubular shape resembling a circular cylinder and attached to the filter base 20, a cover 30 having a tubular shape resembling a circular cylinder and circumferentially surrounding the oil filter body 11.

In this specification and claims, the term "axial direction" signifies a direction in which a base part 11*a* and a head part 11*b* on the opposite side of the base part 11*a* with respect to the filter element 12 are opposed to each other, the term "diametrical direction" signifies a direction parallel to a diameter of the oil filter body 11, and the term "circumferential direction" signifies a direction along the circumference of the oil filter body 11. The terms "longitudinal" and "transverse" and the like are used to modify directions and positions with respect to the internal combustion engine as mounted on a vehicle body.

The oil filter body 11 has a tubular filter case 13 for holding the filter element 12 therein. The filter case 13 has a shape resembling a circular cylinder. The oil filter body 11 has the base part 11*a* to be joined to the filter base 20 in an oil-tight fashion, and the head part 11*b* axially opposite the base part 11*a*. The base part 11*a* has a joining surface 11*e* which can be closely joined to the filter base 20 in an oil-tight fashion, and an attaching part 11*f* for fastening the oil filter body 11 to the filter base 20 and the cover 30. The attaching part 11*f* is a tubular member provided with an external thread screwed into an internally threaded hole formed in the filter base 20. The attaching part 11*f* has an exit

11*h*. The oil passed through the filter element 12 flows through the exit 11*h* into an oil passage. The filter case 13 has a polyhedral part 11*c* having flat surfaces formed in its outside surface in a part near the head part 11*b*. A tool is engaged with the polyhedral part 11*c* and the oil filter body 11 is turned by the tool to screw the attaching part 11*f* into the internally threaded hole of the filter base 20. The axial direction is parallel to the center axis L of the filter case 13, namely, the axis of the oil filter body 11. The screwing direction of the oil filter body 11 is parallel to the axial direction.

Figure 3:
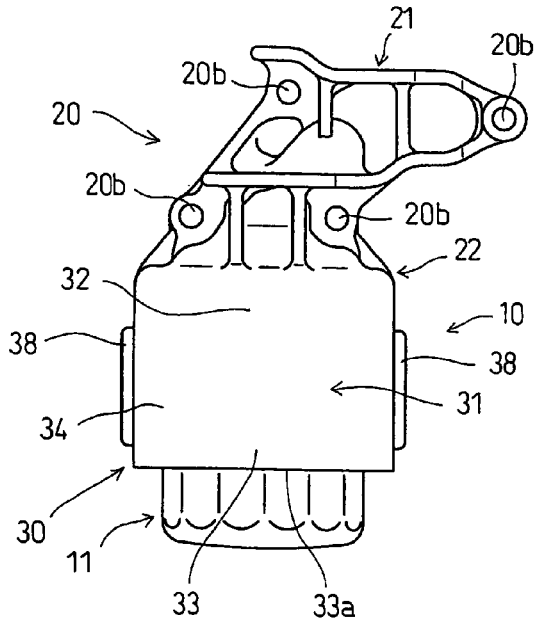
FIG. 3 is a view of an oil filter mounted on the internal combustion engine shown in FIG. 1, taken in the direction of the arrow III in FIG. 1.

Referring to FIGS. 1 and 2, the lower block 2 is provided on its rear surface with a filter mounting seat 2*a* to hold the oil filter 10 between the engine body and an exhaust pipe 5 disposed behind the engine body. The filter base 20 is fastened to the filter mounting seat 2*a* with bolts B1 (FIGS. 1 and 2) passed through bolt holes 20*b* (FIG. 3).

Figure 4:
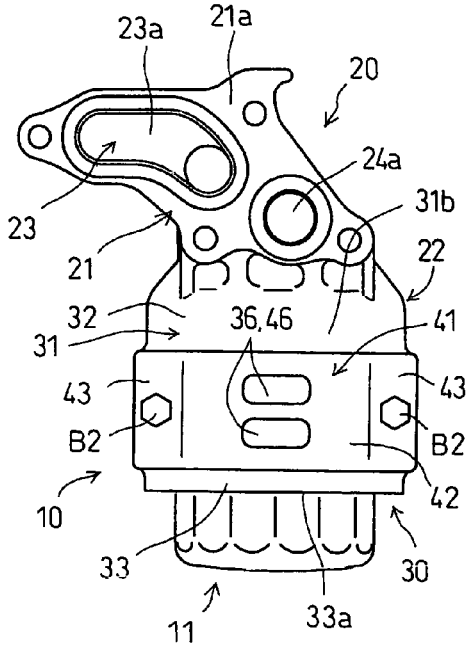
FIG. 4 is a view of the oil filter taken in the direction of the arrow IV in FIG. 1.

Referring to FIGS. 1 and 4, the filter base 20 has an attaching part 21 having a joining surface 21*a* closely joined to the joining surface 2*a*1 of the filter mounting seat 2*a*, and a mounting seat 22 having a joining surface 22*a* closely joined to the joining surface of the oil filter body 11. The filter base 20 is provided with an inlet passage 23 having an inlet port 23*a* (FIG. 4) opening in the joining surface 21*a*, and an outlet passage 24 (FIG. 1) having an outlet port 24*a* (FIG. 4) opening in the joining surface 21*a*. The oil discharged into the discharge passage 8 flows through the inlet passage 23 to the oil filter body 11. The clean oil passed through the filter element 12 and discharged through the exit 11*h* flows through the outlet passage 24 into the main gallery. The oil filter body 11 is fixedly mounted on the mounting seat 22 of the oil filter base 20 by screwing the attaching part 11*f* into the internally threaded hole of the oil filter base 20.

In a state in which the oil filter 10 is fixedly mounted on the filter mounting seat 2*a*, the mounting seat 22, the cover 30 and the oil filter body 11 are disposed in the following arrangement.

The filter 11 and the cover 30 extend axially and correspond substantially with the oil pan 3. The cover 30 and the mounting seat 22 shield the oil filter body 11 from the catalytic converter 4 and the exhaust pipe 5 to protect the oil filter body 11 from heat generated by the catalytic converter 4 and the exhaust pipe 5. The joining surface 22*a* faces downward. Therefore, the oil filter body 11 is held with the base part 11*a* on the upper side and the head part 11*b* on the lower side. In a direction from the base part 11*a* to the head part 11*b* and from a base part 32 to an end wall 33*a* of the cover 30, the common axis of the oil filter body 11 and the cover 30, perpendicular to the joining surface 22*a*, extends in such a direction inclined relative to the vertical direction that the common axis is farther from the exhaust pipe 5 connected to the catalytic converter 4 attached to the cylinder head, with distance from the joining surface 22*a*.

The cover 30 axially extending from the mounting seat 22 has a cover body 31 having a shape resembling a circular cylinder, formed integrally with the filter base 20 and having a diameter greater than that of the joining surface 22*a*, and a reinforcing member 41 detachably attached to the cover body 31 to reinforce the cover body 31. The filter base 20 and the cover body 31 are made of aluminum material for weight reduction. The reinforcing member 41 is made of a ferrous material having strength higher than that of the material forming the cover body 31 to provide the cover 30 with a high rigidity.

The cover body 31 is substantially coaxial with the oil filter body 11 with respect to the center axis L. The cover body 31 is axially divided into three parts. As shown in FIG. 1, the cover body 31 has the base part 32 formed integrally with the mounting seat 22, the end part 33 having an end wall 33*a* axially opposite the base part 32, and a middle part 34 extending between the base part 32 and the end part 33. The middle part 34 is provided with a window part 36. The base part 32 is an endless annular wall axially extending between the mounting seat 22 and the window part 36 and circumferentially surrounding the joining surface 22*a* and the base part 11*a* of the oil filter body 11. The end part 33 is provided in its end wall 33*a* with an opening 31*a* facing downward. The end part 33 is an endless annular wall axially extending between the window part 36 and the end wall 33*a* and circumferentially surrounding the corresponding part of the oil filter body 11. A part of the oil filter body 11 corresponding to the window part 36 of the middle part 34 faces diametrically outside. An annular space 35 (FIG. 2) formed between the oil filter body 11 and the cover 30 opens diametrically through the window part 36.

The base part 32 and the end part 33 are circumferentially endlessly continuous. The middle part 34 is a partly open cylinder through which a part of the oil filter body 11 is exposed to the outside.

The cover 30 extends axially downward from the filter base 20 to a position below the exhaust pipe 5 in a space between the oil pan 3 and the exhaust pipe 5. The length, namely, the axial dimension, of the cover 30 is substantially equal to or greater than the outside diameter of the oil filter body 11 (or the filter case 13). The end wall 33*a* coincides with the end 11*c*1 of the polyhedral part 11*c* on the side of the base part 32. The lower end 33*a*1 (FIG. 1) of the end wall 33*a* is at a level below the catalytic converter 4 and the exhaust pipe 5. Thus the cover 30 covers most part of the oil filter body 11 with respect to the axial direction.

Figure 5:
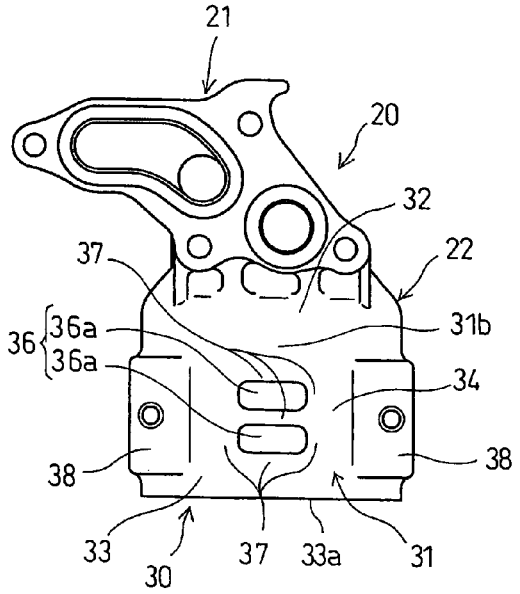
FIG. 5 is a view similar to FIG. 4, in which an oil filter body and a reinforcing member are removed.

As shown in FIG. 1, the window part 36 through which air can flow between the annular space 35 and the space surrounding the cover 30 is formed in a part 31*b* of the cover body 31 on the side opposite the side of the exhaust pipe 5 and facing the oil pan 3 with respect to the diametrical direction. As shown in FIG. 5, the window part 36 includes a single or a plurality of openings. In this embodiment, the window part 36 includes two axially adjoining openings 36*a*. The openings 36*a* have a shape resembling a circumferentially elongate rectangle. The openings 36*a* are formed in a part of the cover 30 on the side opposite the side of the exhaust pipe 5 and facing the oil pan 3 with respect to the diametrical direction. The number and size of the openings 36*a* are determined taking into consideration effects of the openings 36*a* on cooling the oil filter body 11, on the reduction of the rigidity of the cover body 31 and on the suppression of resonance to be described later. Since the window part 36 opens forward, wind resulting from the running of the vehicle flows through the window part 36 into the annular space 35 and flows to the outside from the cover 30 through the opening 31*a* (FIG. 2).

The interval d (FIG. 1) with respect to the diametrical direction between the filter body 31 and the oil pan 3 is substantially equal to or smaller than the distance with respect to the diametrical direction between the oil filter body 11 and the cover 30.

Since the cover 30 and the oil pan 3 are close to each other with respect to the diametrical direction, the oil pan 3 facing the part 31*b* of the cover body 3 resonates in some cases with noise or sound radiated by the cover 30 and propagating through the space 39 (FIG. 1) between the cover 30 and the oil pan 3, if the frequency of the sound radiated by the cover 30 is equal to the natural frequency of the oil pan 3 and the sound is intensified. The cover 30 is vibrated by sound radiated from the oil filter body 11, which is vibrated by the pulsative pressure of the oil. Since the window part 36 is formed in the part 31*b* of the cover 30 so that the area of the part 31*b* is small, the degree of the oil pan 3 being vibrated by the sound radiated by the cover 30 is reduced and hence the resonance can be suppressed.

The cover 30 is held on the filter base 20 such that the end part 33 is farther from the exhaust pipe 5 than the base part 32. Therefore, the cover 30 prevents splashing of the oil that has leaked from the joining surface 22*a* of the mounting seat 22 when the filter 11 is disconnected from the filter base 20 and removed through the opening 31*a* for maintenance or the like. Moreover, contamination of the exhaust pipe 5 with the oil that has dripped from the end wall 33*a* can be prevented. The window part 36 opening diametrically outward faces obliquely upward. Therefore, the oil that has leaked from the joining surface 22*a* when the oil filter body 11 is removed is prevented from dripping to the outside from the cover 30 through the window part 36.

Figure 6:
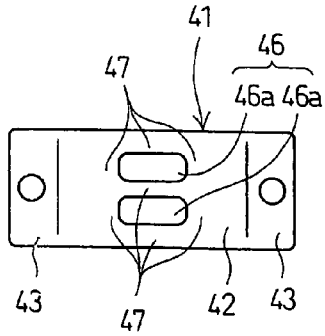
FIG. 6 is a view of a reinforcing member shown in FIG. 4.
Figure 7:
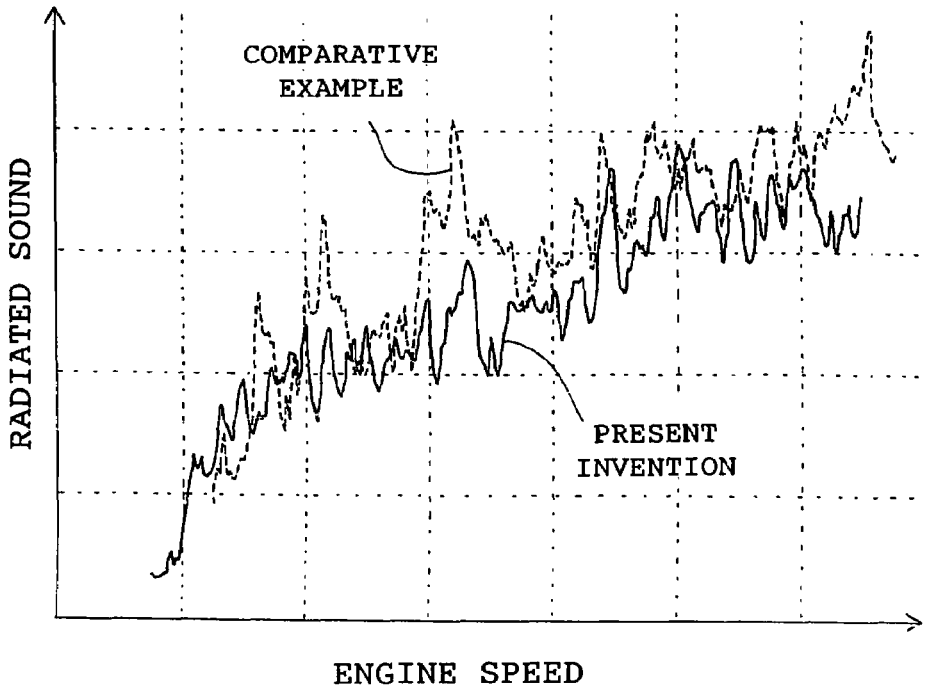
FIG. 7 is a graph comparatively showing variation, with engine speed, of sound radiated by an oil filter used in the present invention and variation, with engine speed, of sound radiated by an oil filter provided with a cover shown in FIG. 12 in a comparative example.

FIG. 6 shows the reinforcing member 41 made by processing a plate. The reinforcing member 41 is attached to the outside surface of the part 31*b* of the cover body 31 so as to cover at least the window part 36 entirely with respect to the axial and the circumferential direction. The reinforcing member 41 facing the oil pan 3 is provided with an opening part 46 aligned with the window part 36 with respect to the diametrical direction. The reinforcing member 41 has a cylindrical covering part 42 extending along the outside surface 31*a* of the cover body 31, and two attaching parts 43 extending outward from the opposite ends, respectively, of the covering part 42. The width, namely, the axial dimension, of the covering part 42 is greater than the width of the middle part 34 dependent on the axial dimension of an area in which the window part 36 is formed. An edge part 47 of the covering part 42 around the opening part 46 overlaps an edge part 37 around the window part 36, respectively. The number and shape of openings 46*a* included in the opening part 46 are substantially the same as those of the openings 36*a* of the window part 36. Thus the window and opening parts 36 and 46 have substantially the same shape and hence substantially entirely coincide with each other with respect to the diametrical direction when the reinforcing member 41 is attached to the cover body 31. The edge part 47 of the covering part 42 is in contact with the edge part 37 or is spaced a small distance apart in the diametrical direction from the outside surface 31*s* of the cover body 31. Thus the edge part 47 limits the amplitude of vibrations of the edge part 37 around the window part 36 with respect to the diametrical direction when the cover body 31 vibrates.

The attaching parts 43 are fastened to bosses 38 (FIG. 5) formed in the middle part 34 on the circumferentially opposite sides of the window part 36, respectively, with bolts B2. The reinforcing member 41 increases the rigidity of the cover body 31, especially the rigidity of the cover body 31 around the window part 36, and the mass of the reinforcing member 41 is effective in reducing the amplitude of vibration of the cover body 31. The bosses 38 formed integrally with the cover body 31 enhance the rigidity of the cover body 31.

Figure 12:
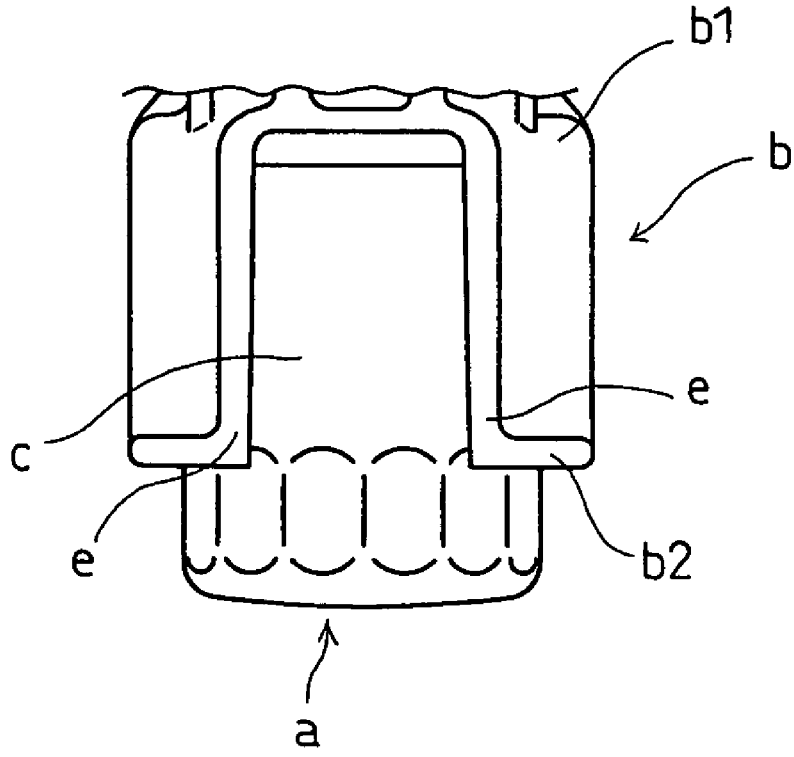
FIG. 12 is a view of an oil filter in a comparative example.

In this embodiment, the cover 30 has the circumferentially endless, annular end part 33 and the window part 36 and is provided with the reinforcing member 41. Therefore, as obvious from FIG. 7, the level of sound radiated by the oil filter 10 is lower than the level of sound radiated by an oil filter in Comparative Example 1 shown in FIG. 12.

The operation and effect of the internal combustion engine in the preferred embodiment will be described.

The oil discharged from the oil pump 7 driven by the internal combustion engine flows through the oil filter 10. The annular space 35 formed between the oil filter body 11 and the cover 30 opens diametrically through the window part 36 and hence air can flow into and can flow to the outside from the annular space 35 between the oil filter body 11 and the cover 30 through the window part 36. Therefore, the oil filter body 11 can be properly cooled by air even though most part of the oil filter body 11 is covered with the cover 30. Wind flows through the window part 36 opening forward into the annular space 35 and leaves the oil filter 10 through the opening 31*a* after cooling the oil filter body 11 while the vehicle is running, to cool the oil filter body 11 more effectively.

The cover 30 has the circumferentially endless, cylindrical end part 33 axially extending between the vent 36 and the end wall 33*a*. The end part 33 increases the rigidity of the cover 30 provided with the vent 36 and suppresses the vibration of the cover 30 caused by the sound radiated by the oil filter body 11 vibrated by the pulsating pressure of the oil discharged from the oil pump 7. Consequently, the sound radiated by the cover 30 can be reduced.

The cover 30 has the cover body 31 and the reinforcing member 41 attached to the cover body 31, the cover body 31 includes the end part 33, and the edge part 47 of the reinforcing member 41 around the opening part 46 coincides with the edge part 37 of the cover 30 around the window part 36 with respect to the diametrical direction. The oil filter body 11 can be cooled by air that flows into or flows out from the annular space 35 through the window and opening parts 36 and 46. The reinforcing member 41 enhances the rigidity of a part of the cover 30 around the window part 36. Therefore, sound that may be radiated by the cover 30 having a rigidity reduced by the formation of the window part 36 can be reduced. The edge part 47 around the opening part 46 overlapping the edge part 37 around the window part 36 enhances the rigidity of the edge part 37 around the window part 36 and hence the sound radiated by the cover 30 can be reduced still further. The characteristics of the sound radiated by the cover 30 can be changed by forming the reinforcing member 41 of a material different from that of the cover body 31 or properly adjusting the mass of the reinforcing member 41. Therefore, specific sound radiated by the cover 30 when the internal combustion engine operates at engine speeds in an engine speed range in which the internal combustion engine operates frequently can be reduced, and an effective range of radiated sound reducing effect can be adjusted according to the frequency of the pulsating oil pressure.

The bosses 38 formed integrally with the cover body 31 enhance the rigidity of the cover body 31, which contributes to reducing the sound radiated by the cover 30.

The window part 36 faces the oil pan 3 with respect to the diametrical direction. Therefore, the resonance of the sound radiated by the cover 30 in the space between the cover 30 and the oil pan 3 can be suppressed even if the cover 30 is close to the oil pan 3. Thus the sound radiated by the cove 30 can be reduced.

The cover 30 provided with the opening 31*a* extends downward from the filter base 20 in the space between the oil filter body 11 and the exhaust pipe 5 and the end wall 33*a* is at a level below the exhaust pipe 5. Thus the dripping of the oil that has leaked from the mounting seat 22 of the filter base 20 onto the exhaust pipe 5 can be avoided and effect of preventing the contamination of the exhaust pipe 5 with the oil can be enhanced.

Modifications of the foregoing embodiment will be described.

Figure 8:
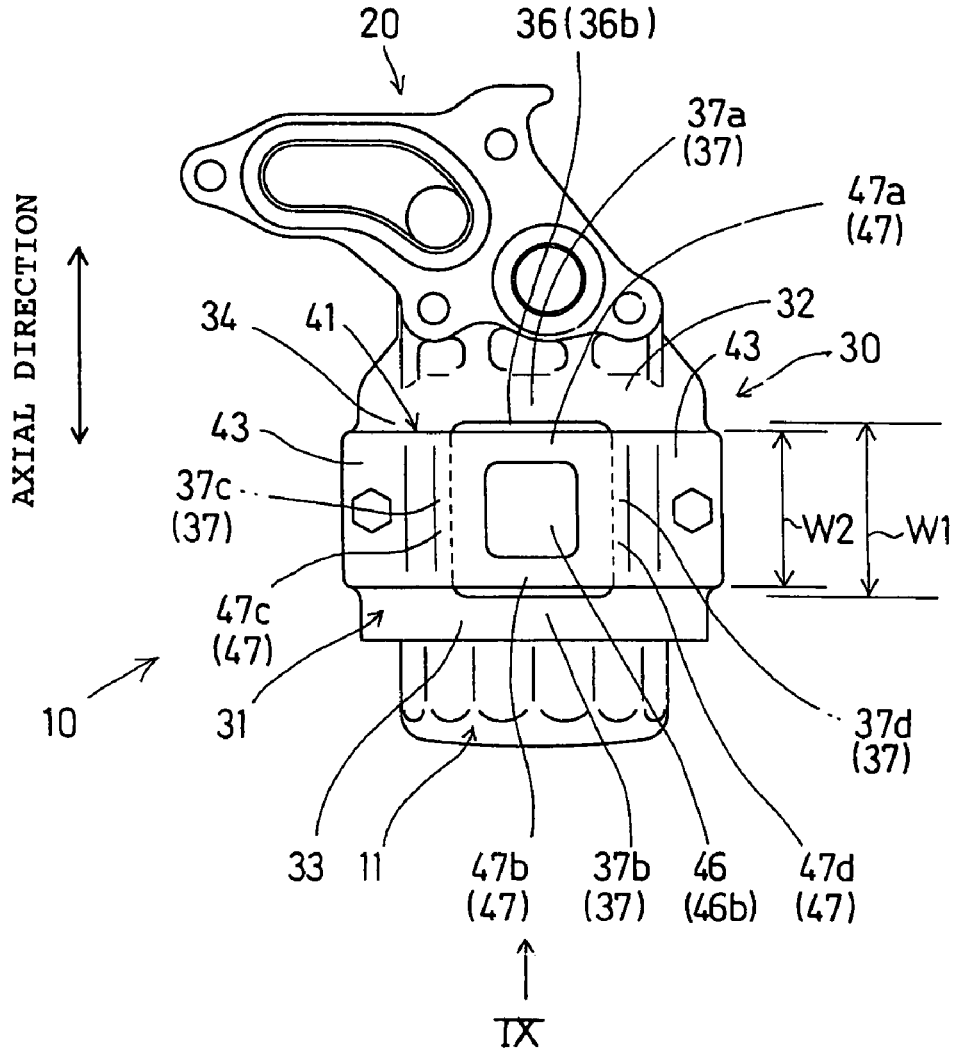
FIG. 8 is a view, similar to FIG. 4, of an oil filter in a modification.
Figure 9:
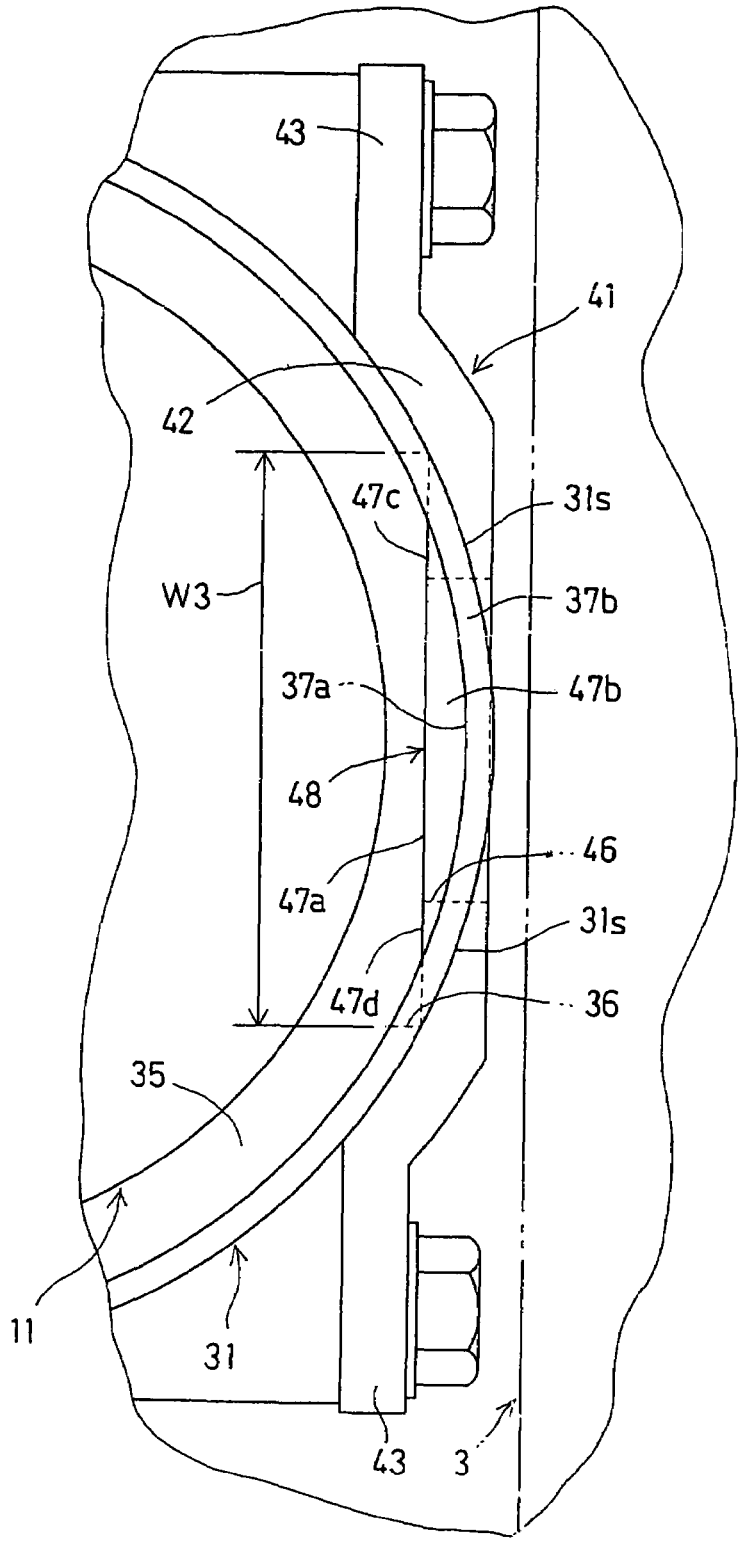
FIG. 9 is an enlarged view of an essential part of the oil filter shown in FIG. 8 taken in the direction of the arrow IX in FIG. 8.

An oil filter 10 in a modification will be described with reference to FIGS. 8 and 9, in which parts like or corresponding to those of the oil filter 10 employed in the foregoing preferred embodiment are designated by the same reference characters.

The oil filter 10 in this modification has a filter base 20, an oil filter body 11 and a cover 30 including a cover body 31. The cover body 31 has a base part 32, a circumferentially endless, annular end part 33 covering the circumference of the oil filter body 11, and a middle part 34 provided with a window part 36 facing an oil pan 3 with respect to a diametrical direction. The window part 36 is a single opening 36*b* having a width W1, namely, an axial dimension, greater than the width W2 of a reinforcing member 41. The reinforcing member 41 has two attaching parts 43, and a covering part 42 extending between the attaching parts 43 and provided with an opening part 46 overlapping the window part 36 with respect to the diametrical direction. The opening part 46 is a single opening 46*b*. Circumferentially opposite side parts 47*c* and 47*d*, which are parts of an edge part 47 around the opening part 46, coincide opposite side parts 37*c* and 37*d* of an edge part 37 around the window part 36 of the cover body 31 with respect to the diametrical direction, respectively. The covering part 42 is disposed such that the side parts 47*c* and 47*d* are in contact with the side parts 37*c* and 37*d*, respectively, to limit the amplitude of vibrations in the diametrical direction of the side parts 37*c* and 37*d* when the cover body 31 vibrates.

The width W3, namely, a circumferential dimension, of the opening 36*b* is substantially equal to or greater than the width W1. Parts of the covering part 42 extending over the window part 36 with respect to the diametrical direction are positioned on the diametrically inner side of axially opposite side parts 37*a* and 37*b* forming the edge part 37 together with the circumferentially opposite side parts 37*c* and 37*d*, i.e., on the inner side of the outside surface 31*s* of the cover body 31, in a projecting parts 48. The projecting parts 48 include the circumferentially opposite side parts 37*c* and 47*d* and the axially opposite side parts 47*a* and 47*b* of the edge part 47.

The oil filter 10 in this modification exercises the following operations and effects in addition to those similar to those of the oil filter 10 in the foregoing preferred embodiment. Since the reinforcing member 41 has the projecting parts 48 projecting diametrically into the window part 36 facing the oil pan 3, the cover 30 can be moved toward the oil pan 3 by a distance corresponding to the length of the projecting parts 48 retracted diametrically inward from the outside surface 31*s* of the cover body 31 and hence the oil filter 10 can be disposed in a narrow space in the engine body.

The filter base 20 and the cover 30 may be made of different materials, respectively, and may be connected together, and the filter base 20 may be formed integrally with the engine body, such as the lower block 2.

The window part 36 may include a plurality of circumferentially arranged openings.

The reinforcing member 41 may be disposed on the diametrically inner side of the cover body 31.

The edge part 37 surrounding the openings 36*a* of the window part 36 of the cover body 31 may be formed in a thickness greater than those of other parts of the cover body 31 so that the edge part 37 may serve as a reinforcement.

The cover 30 may extends axially beyond the head part 11*b* of the oil filter body 11, provided that the oil filter body 11 can be properly cooled by air that flows through the window part 36. When the cover 30 is thus extended beyond the head part 11*b* of the oil filter body 11, the opening 31*a* of the end wall 33 of the cover 30 may be closed by a cup-shaped wall including the end wall 33*a* including the edge part 37.

Figure 10:
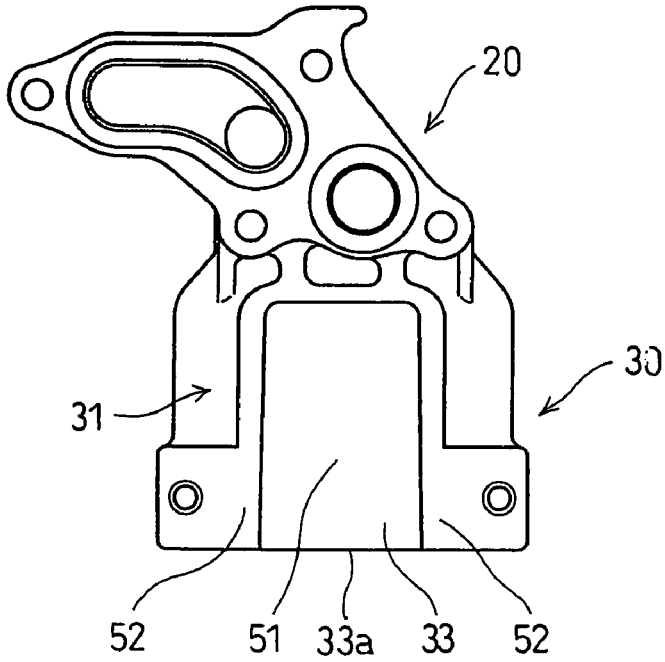
FIG. 10 is a view, similar to FIG. 5, of an oil filter in a further modification.
Figure 11:
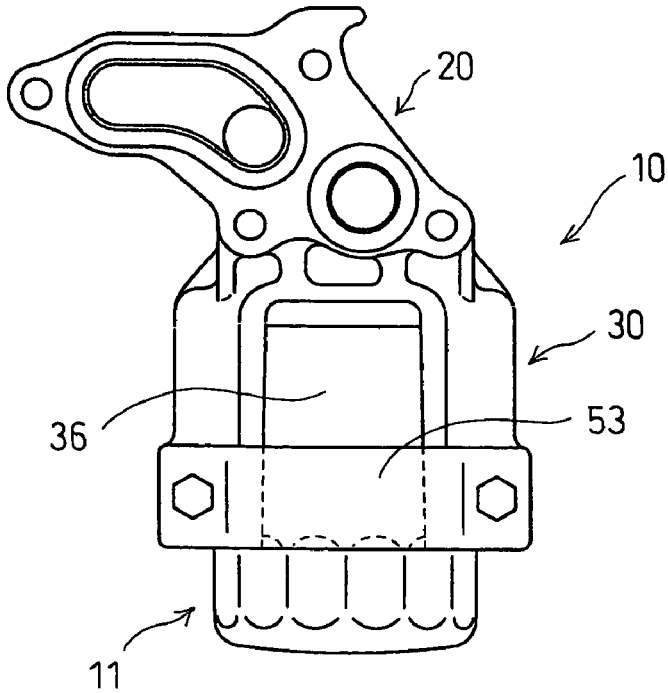
FIG. 11 is a view, similar to FIG. 4, of an oil filter in a still further modification.

FIGS. 10 and 11 show further modifications. In an oil filter 10 including a filter base 20, an oil filter body and a cover 30, a cover body 31 may be provided with an opening 51 extending from an end part 33 having an end wall 33*a* toward a base part 32, circumferentially opposite edge parts 52 in the end part 33 may be connected by a reinforcing member 53, and a window part and an endless, annular part (or a continuous part) may be formed in the cover 30 by the cover body 31 and the reinforcing member 53.

Although the internal combustion engine in the embodiments have been described on an assumption that the internal combustion engine is mounted on a vehicle, the present invention is applicable to an internal combustion engine other than the foregoing internal combustion engine, such as an engine included in a marine propulsion device, such as an outboard engine provided with a vertical crankshaft.

What is claimed is:

1. An internal combustion engine provided with an oil filter for cleaning lubricant oil discharged by a positive-displacement oil pump, said oil filter comprising:

a filter base attached to an engine body of the internal combustion engine; and an oil filter body attached to the filter base, said oil filter body having a base part with a joining surface closely joined to the filter base, and a head part opposite the base part;

wherein the oil filter body is provided with a cover having a base part formed integrally with the filter base and a head part axially opposite the base part of the cover, said cover circumferentially surrounding the oil filter body, the oil filter body and the cover forms a space between the oil filter body and the cover, the cover is provided with a window part through which the space opens diametrically outward, and the cover has a circumferentially endlessly continuous part in a region axially extending between the window part and the head part of the cover.

2. The internal combustion engine according to claim 1, comprising a reinforcing structure for reinforcing an edge part of the window part of the cover.

3. The internal combustion engine according to claim 1, wherein the cover includes a cylindrical cover body provided with the window part, and a reinforcing member attached to the cover body and having an opening part coinciding with the window part of the cover body, the continuous part is formed integrally with the cover body, and an edge part around the opening part of the reinforcing member coincides with an edge part around the window part of the cover body.

4. The internal combustion engine according to claim 1, wherein the window part of the cover is formed at a position diametrically opposite the engine body.

5. The internal combustion engine according to claim 1, wherein the head part of the cover is provided with an axial opening, and the cover is disposed between the oil filter and an exhaust pipe connected to the engine body so as to extend downward from the filter base such that the head part of the cover is at a level below the exhaust pipe.

6. The internal combustion engine according to claim 1, wherein the space between the oil filter body and the cover is an annular space.

7. The internal combustion engine according to claim 1, wherein the window part of the cover includes a plurality of axially adjoining holes.

8. The internal combustion engine according to claim 2, wherein the reinforcing structure is formed of a plate, and includes a pair of holding parts attached to parts of the cover respectively on the circumferentially opposite sides of the window part, and a covering part having a sectional shape resembling a circular arc and extending along the circumference of the oil filter body between the pair of holding parts.

9. The internal combustion engine according to claim 8, wherein the covering part is provided with an opening part of a shape corresponding to that of the window part of the cover.

* * * * *